United States Patent [19]

Jordan

[11] Patent Number: 4,685,834

[45] Date of Patent: Aug. 11, 1987

[54] SPLAY BOTTOM FLUTED METAL PILES

[75] Inventor: Otis D. Jordan, N. Canton, Ohio

[73] Assignee: Sunohio Company, Canton, Ohio

[21] Appl. No.: 881,453

[22] Filed: Jul. 2, 1986

[51] Int. Cl.[4] ..... E02D 5/44

[52] U.S. Cl. ..... 405/237; 405/232

[58] Field of Search ..... 405/237, 238, 242, 241, 405/239, 232, 233, 243

[56] References Cited

U.S. PATENT DOCUMENTS

| | | | |
|---|---|---|---|
| 1,296,995 | 3/1919 | Miller | 405/238 |
| 1,443,306 | 1/1923 | Blumenthal | 405/238 |
| 2,007,668 | 7/1935 | Watt | 405/237 |
| 3,209,546 | 10/1965 | Lawton | 405/238 |

FOREIGN PATENT DOCUMENTS

| | | | |
|---|---|---|---|
| 531020 | 8/1954 | Belgium | 405/237 |
| 1942792 | 2/1971 | Fed. Rep. of Germany | 405/239 |
| 0085421 | 5/1982 | Japan | 405/237 |
| 0029917 | 2/1983 | Japan | 405/238 |
| 469716 | 7/1937 | United Kingdom | 405/237 |
| 525548 | 8/1940 | United Kingdom | 405/237 |

*Primary Examiner*—Dennis L. Taylor
*Attorney, Agent, or Firm*—Sand & Hudak

[57] ABSTRACT

A metal pile has a splayable fluted bottom portion, the perimeter of which is greater than the nominal perimeter of the pile. A fluted expansion cone is located in the interior of the pile and is connected to the splayable fluted bottom portion. The flutes of the bottom portion, as well as of the expansion cone, desirably have exterior and interior edges which are substantially straight and sides portions therebetween which are substantially planar. The expansion cone generally has an acute apex angle. Once the pile is in place in the earth, the splayable flutes bottom portion can be horizontally expanded to a much larger diameter by applying a force to the top of the expansion cone which flattens the cone and imparts a horizontal expansion force and causes the fluted bottom portion of the pile to splay. When the diameter of the bottom portion of the pile has been increased, the pile will have significantly improved load bearing capacity and thus reducing the depth of penetration otherwise normally required.

19 Claims, 5 Drawing Figures

SPLAY BOTTOM FLUTED METAL PILES

TECHNICAL FIELD

The present invention relates to a pile having a splayable fluted bottom portion and more specifically to a such a pile which has a fluted expansion cone in said bottom portion so that the diameter thereof can be expanded.

BACKGROUND OF THE INVENTION

Heretofore, piles have been utilized to bear the weight of buildings, machinery, and other structures and devices. The piles are generally tubular and they are often fluted at a uniform depth from top to bottom for the purpose of increasing their resistance to collapsing during driving but not for the purpose of permitting radial expansion. The piles also have pointed driving tips attached to the bottom thereof so that they can be driven into the earth by a pile driver. Piles are generally constructed so that as they are driven into the earth, additional piles can be connected to the top of the preceding pile and welded thereto. Any number of piles can be connected and driven into the earth until they meet an unyielding strata, such as bedrock. However, in a majority of situations, bedrock is not encountered and the piles are driven until a desirable resistance from the friction of the penetrated strata, plus the resistance encountered from the driving point, yields a desirable load-bearing capacity. Once in place, the uppermost pile is normally cutoff at a desirable height, the piles filled with concrete, and subsequently incorporated into a foundation.

A variation of the above procedure is to fill the lowermost portion of the bottom pile with concrete. A heavy weight is then dropped through the piles with the resulting impact hopefully causing the lowermost pile portion to expand horizontally outward. At best, this procedure is very tenuous and does not yield repeatable results.

SUMMARY OF THE INVENTION

It is therefore an aspect of the present invention to provide a pile having an expandable fluted bottom portion.

It is yet another aspect of the present invention to provide a pile having an expandable fluted bottom portion, as above, wherein a fluted expansion cone is located therein and is connected to said bottom portion.

It is a further aspect of the present invention to provide a pile having an expandable fluted bottom portion, as above, wherein the perimeter of the splay fluted bottom portion is greater than the nominal perimeter of the pile.

It is yet another aspect of the present invention to provide a pile having an expandable fluted bottom portion, as above, wherein the fluted bottom portion and the fluted expansion cone have interior and exterior edges which are substantially straight.

These and other aspects of the present invention will become apparent from the following detailed description of the invention.

In general, a pile comprises the pile, said pile having a splayable fluted bottom portion, and an expansion cone, said expansion cone having a base, said expansion cone base connected to said splayable fluted bottom portion.

DETAILED DESCRIPTION OF THE INVENTION

According to the concepts of the present invention, a pile having splayable fluted bottom portion can be expanded in-situ through an expansion cone. The pile also contains a conventional driving point.

Figure 2:
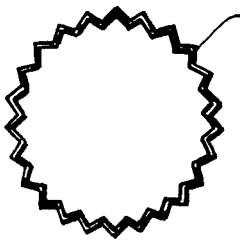
FIG. 2 is a cross-sectional view through a top portion of the pile taken on line 2—2, of FIG. 1.
Figure 1:
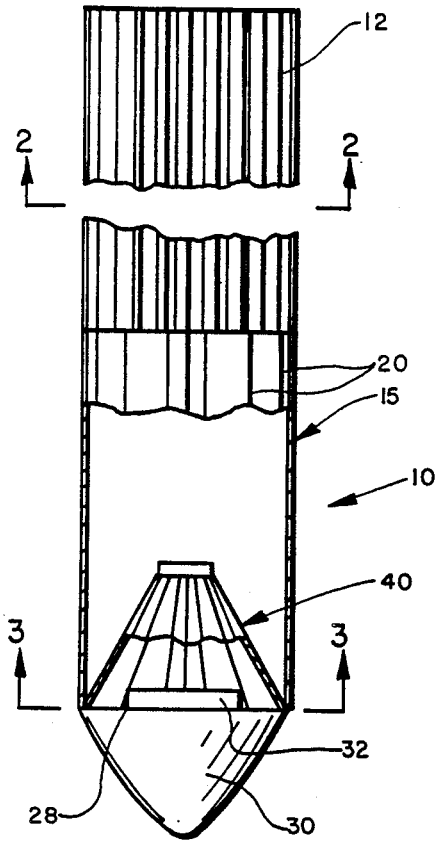
FIG. 1 is a side elevational view showing a pile of the present invention having a splayable fluted bottom portion.

Referring to FIG. 1, a pile, generally indicated by the numeral 10, contains a tubular body 12. The body of the pile can be made of any suitable or conventional metal, such as steel, and have any shape, such as rectangular, circular, or the like. Pile body 12 can have straight sides, be slightly tapered outward or desirably be tapered inward towards the bottom portion. The amount of taper is generally about 1 inch of width for every 15 feet of length. The surface of the pile body can generally be smooth or contain small uniform flutes therein as shown in FIG. 2. That is, the flutes have a uniform dept throughout the length of the pile. The uniform flutes serve a two-fold purpose in that they impart greater strength to the pile as well as produce a greater surface area and hence increase frictional contact with the earth.

Figure 3:
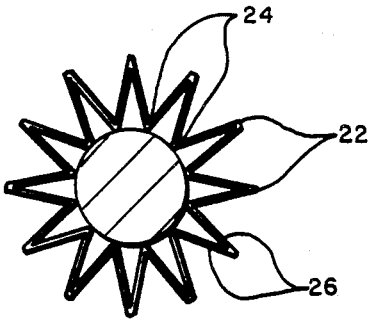
FIG. 3 is a cross-sectional view through the bottom end of the splayable fluted bottom portion and is taken on line 3—3, of FIG. 2.
Figure 4:
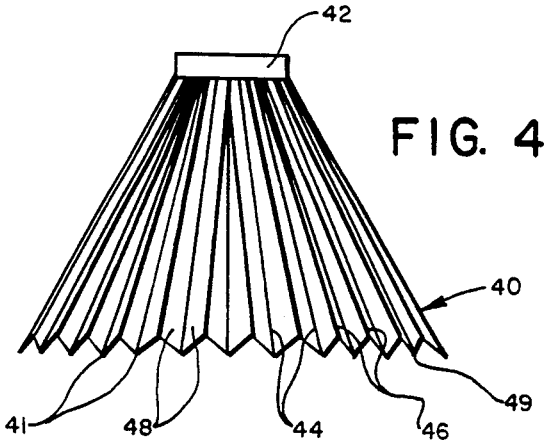
FIG. 4 is a side elevational view showing the expansion cone.
Figure 5:
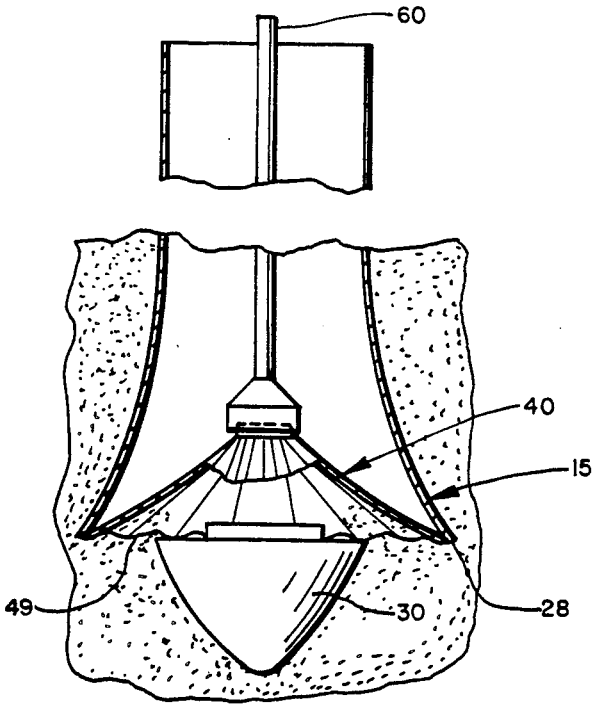
FIG. 5 is a side elevational view showing the piling splay in place in the earth.

According to the present invention, a conventional pile as described in the preceding paragraph, has a splayable fluted bottom portion, generally indicated by the numeral 15. Bottom portion 15 has deep serrations or flutes 20 as best seen in FIG. 3. These serrations are much deeper than the optional uniform flutes of the top portion. It is an important aspect of the present invention that bottom interior edges 24 and bottom exterior edges 22 be pronounced so that they can be expanded in a radially outward manner. That is, since the flutes are generally deep, the resulting pile metal at the bottom portion 16 is thinner than the upper pile portion and thus can be hinged about the edges in a radially outward manner. The bottom flutes are thus splayable. The extent of fluting of bottom portion 15 is such that the perimeter thereof bottom is at least 10% greater than the perimeter taken at a nominal pile diameter such as at line 2—2 of FIG. 1 and desirably is at least 100% greater than the nominal perimeter. Since the depth of the flutes increases as one proceeds from the initial appearance of the flutes in a downward direction to the lowermost or end 28 of the bottom portion, the the perimeter at the end of the bottom portion will be the greatest. The above perimeter ranges refer to the perimeter at end 28. The vertical or height extent of splayable flutes 20 on the side of the pile is usually from about 2 to about 4 nominal diameters of the pile, and preferably from about 2 to about 3 nominal diameters.

Although the cross section of the splayable fluted bottom portion can generally be of any shape, such as curvilinear, it is highly desirable that exterior edges 22 actually form points, that is, an acute angle. Similarly, it is desirable that interior edges 24 also form points and thus an acute angle. The vertical extent of any exterior edge 22 is thus substantially a straight line and the vertical extent of interior edge 24 is also substantially a straight line. The side portions of the flute, that is, the area between exterior edge 22 and interior edge 24, can be of any shape such as curivilinear. However, once again it is highly desirable that sides 26 be substantially straight, that is, form a vertical plane. The preference for angle edges and the resulting vertical straight lines as well as the planar sides, is to create a hinge effect so that upon expansion of splayable fluted bottom portion 15, the flutes can readily expand in a radially or horizontally outward direction. Generally, the internal edges 24 extend the same radially inward distance as shown in FIG. 8.

A conventional driving point 30 is connected to the bottom of fluted bottom portion 15. The type of connection can be in accordance with any conventional manner such as welding. Since driving point 80 will generally be split apart from the fluted bottom portion upon expansion thereof, it is generally spot welded thereto. Driving point 30 has a boss portion 32. The diameter of boss portion 32 is generally of an extent such that it fits or resides within the diameter created by the interior edges of the bottom flutes. Thus, if desired, a frictional fit between the perimeter of boss 32 and the plurality of interior edges 24 can exist. Driving point 30 is generally made of any suitable hard metal to enable it to penetrate the earth.

Another important aspect of the present invention is the existence of an expansion cone generally indicated by the numeral 40. The expansion cone typically can be made of any suitable metal, such as steel, and have any shape. Desirably, the cone is conical and has a truncated top portion. The expansion cone desirably has flutes 41 thereon. Flutes 41 of the expansion cone are similar to flutes 20 of the splayable bottom portion of the pile in that they have exterior edges 44 and interior edges 46. The exterior edges are desirably points, such as angles, and hence form substantially straight lines along the outer surface of the cone. Similarly interior edges 46 are points or angles that form substantially straight lines along the inner surface of the cone. The distance from interior edge 46 to exterior edge 44 increases as it proceeds in a downward direction along the cone. Exterior edges 44 and interior edges 46 engage the lowermost portion or end 28 of splayable fluted bottom portion 15. Moreover, edges 44 and valleys 46 of the expansion cone flutes can matingly engage their counterparts of the splayable fluted bottom portion 15

As shown in FIG. 1, the base of the expansion cone is desirably connected to the lowermost or end 28 of the fluted bottom portion 15 in any conventional manner, as for example, welding. Flutes 41 add rigidity and strength to the expansion cone as well as permit the lowermost portions thereof to be expanded in a radially or horizontally outward direction. The side portions 48 of the flutes, that is, the portions which extend between edges 44 and valleys 46 are also desirably straight and hence form a plane. Once again, the existence of straight exterior edges 44, straight interior edges 46, and planar sides 48 creates a hinge effect so that upon application of a force to top cap 42, interior edges 46 and flute sides 48 can be hinged outwardly and expand the perimeter of the expansion cone. Naturally, the greatest expansion will occur at the lowermost portion or base 49 of the expansion cone since, as noted, the distance between exterior edges 44 and interior edges 46 are greatest at this point.

When an initial maximum radial expansion force against end 28 of splayable fluted bottom portion 15 is desired, the height of the expansion cone is the least possible height that will allow full expansion of the bottom outer perimeter as it is flatten out by a given force applied to its apex. That is, the apex formed by the cone is generally the greatest angle possible. Smaller radial forces can of course be utilized and thus the cone height can be higher. Suitable apex angles can be from about 30 to about 90 degrees and preferably from about 60 to about 90 degrees. In terms of the nominal pile diameter, the height of the expansion cone is thus determined by the selected apex angle. The provision of an expansion cone having such an apex angle thus ensures that upon the application of a force to top cap 42, a very large force component is transferred to the base of the expansion cone thereby causing end portion 28 of the fluted bottom portion 15 to expand. As a sufficient force is continually applied to the conical cone, it causes the cone to flatten with cone base 49 thereby continually expanding in a radially outward direction thereby causing end portion 28 as well as the adjacent portions of fluted bottom portion 15 to expand in a radially outward direction.

The operation of the splayable fluted bottom metal pile is as follows. Tubular pile 12 having a splayable fluted bottom portion 15 thereon, an expansion cone 40 therein and a driving point 30 both of which are attached to the bottom of the pile, are driven into the earth in any conventional manner. One or more conventional piles can be mounted on the top of pile 10 of the present invention and driven into the earth until a predetermined resistance or refusal is reached. A very sturdy shaft is then inserted through the central portion of the piles and placed upon top cap 42 of the expansion cone. A force is then applied to shaft 16 which through top cap 42 causes the expansion cone 40 to expand radially outward. The expansion cone thus causes fluted bottom portion 15 to expand radially outward and especially the lowermost or end portion 2 thereof. The pile bottom portion is thus splay. The creation of a much larger diameter caused by the outwardly hinging of bottom pile flutes 20 significantly improves the load bearing capacity of the pile. Thus, the depth of penetration into the earth need not be as great as with a conventional pile since the increase in bearing area of the pile bottom increases by the square of the increased radius. For example, an increase in the pile bottom diameter of 50% thus results in a load bearing area increase of 125%. The amount of expansion moreover can readily be determined by a simple geometric calculation by observing the relative distance shaft 26 has been forced into the pile once it has been positioned upon top cap 42. The heavy duty shaft is then removed and the pile can be given a few more blows to seat it firmly. The pile is then typically filled with concrete in a conventional manner.

While in accordance with the patent statutes, a best mode and preferred embodiment have been set forth in detail, the scope of the imitation is not limited thereto, but rather by the scope of the attached claims.

What is claimed is:

1. A pile, comprising:

the pile, said pile having a splayable fluted bottom portion, an expansion cone, said expansion cone having flutes, said expansion cone located within said splayable fluted bottom portion, said expansion cone having a base, said expansion cone base connected to said splayable fluted bottom portion, said expansion cone have a top cap located within said splayable fluted bottom portion, said expansion cone and said splayable fluted pile bottom portion capable of being expanded in a radially outward direction upon the application of a force to said top cap whereby said expansion cone flutes and said pile bottom flutes hingedly expand outward.

2. A pile according to claim 1, wherein the perimeter of said expandable splayable fluted bottom portion is at least 10% greater than the nominal perimeter of said pile.

3. A pile according to claim 2, wherein said flutes of said pile bottom portion have exterior edges and interior edges, wherein said flute exterior edges and interior edges form a substantially straight line, and wherein said expansion cone flutes have substantially straight exterior edges and interior edges.

4. A pile according to claim 3, wherein said expansion cone has a truncated top, and wherein said expansion cone has an apex angle of from about 30 to about 90 degrees.

5. A pile according to claim 4, wherein the perimeter of said splayable fluted bottom portion can be at least expandable 100% greater than the nominal perimeter of said pile.

6. A pile according to claim 5, wherein said splayable fluted bottom portion contains essentially planar side surfaces between said exterior edges and said interior edges of said flutes, and wherein said expansion cone flutes contain essentially planar surfaces between said expansion flute exterior and interior edges.

7. A pile according to claim 6, wherein said expansion cone apex angle is from about 60 to about 90 degrees.

8. A pile according to claim 7, including a driving point, said driving point having a boss thereon, said driving point attached to the bottom of said splayable fluted bottom portion.

9. A pile according to claim 3, wherein the height of said splayable fluted bottom portion is from about 2 to about 4 diameters of said pile.

10. A pile according to claim 6, wherein the height of said splayable fluted bottom portion is from about 2 to about 3 diameters of said pile.

11. A process for installing a splayable bottom fluted metal pile, comprising the steps of:

(a) driving the splayable fluted bottom portion pile having a fluted expansion cone located therein into the earth, said fluted expansion cone having a top portion and a base, said base connected to said splayable fluted bottom portion, (b) placing a shaft in said pile on said expansion cone top portion, and (c) applying a force to said shaft and radially expanding outward said splayable fluted bottom portion and said expansion cone so that said fluted bottom portion is splay.

12. A process according to claim 11, wherein the expanded perimeter of said splay fluted bottom portion and said expansion cone base is at least 10% greater than the nominal perimeter of said pile.

13. A process according to claim 12, wherein the height of said expansion cone apex angle is from about 60 to about 90 degrees.

14. A process according to claim 13, wherein said flutes of said pile bottom portion have exterior edges and interior edges, wherein said exterior edges and interior edges form a straight line, wherein said expansion cone has flutes, wherein said expansion cone flutes have straight exterior edges and interior edges, and wherein said bottom pile flutes and said cone flutes hingedly expand outward upon the application of said force.

15. A process according to claim 14, said expansion cone having a truncated top, said shaft residing on said truncated top, and wherein said splay fluted bottom portion and said expansion cone base have a perimeter 100% greater than said nominal pile perimeter. about 90 degrees.

16. A process according to claim 15, wherein said flutes of said fluted bottom portion has planar sides, wherein said flutes of said expansion cone have planar sides.

17. A process according to claim 11, including withdrawing said shaft and filling said splay bottom fluted pile portion with concrete, after said fluted bottom pile portion and said expansion cone is splay.

18. A process according to claim 13, including withdrawing said shaft and filling said splay bottom fluted pile portion with concrete, after said fluted bottom pile portion and said expansion cone is splay.

19. A process according to claim 16, including withdrawing said shaft and filling said splay bottom fluted pile portion with concrete, after said fluted bottom pile portion and said expansion cone is splay.

* * * * *